US006435311B2

(12) United States Patent
Araki et al.

(10) Patent No.: US 6,435,311 B2
(45) Date of Patent: Aug. 20, 2002

(54) ELEVATOR CONTROL CALCULATING POWER CONSUMED AND POWER GENERATED BY A CONTROLLED ELEVATOR

(75) Inventors: Hiroshi Araki; Shinobu Tajima; Ikuro Suga; Kazuyuki Kobayashi, all of Tokyo (JP)

(73) Assignees: Mitsubishi Denki Kabuskiki Kaisha; The Tokyo Electirc Power Company, Ince, both of Tokyo (JP)

( * ) Notice: Subject to any disclaimer, the term of this patent is extended or adjusted under 35 U.S.C. 154(b) by 0 days.

(21) Appl. No.: 09/780,391

(22) Filed: Feb. 12, 2001

(30) Foreign Application Priority Data

Feb. 15, 2000 (JP) ..... 2000-036493

(51) Int. Cl.[7] ..... B66B 1/06
(52) U.S. Cl. ..... 187/290; 187/296; 318/801
(58) Field of Search ..... 187/391, 396, 187/290; 318/375, 376, 798–815; 320/128, 134, 106, 162, 135

(56) References Cited

U.S. PATENT DOCUMENTS 3,585,482 A * 6/1971 Zelina ..... 320/35
4,456,097 A * 6/1984 Salihi ..... 187/29 R
4,554,999 A * 11/1985 Kamike ..... 187/29 R
4,666,020 A * 5/1987 Watanabe ..... 187/114
5,058,710 A * 10/1991 Iwasa ..... 187/114
5,420,491 A * 5/1995 Kanzaki et al. ..... 318/727
5,698,823 A * 12/1997 Tanahashi ..... 187/296
6,121,740 A * 9/2000 Gale et al. ..... 318/376
6,315,081 B1 * 11/2001 Yeo ..... 187/290

FOREIGN PATENT DOCUMENTS

JP 61-267675 11/1986
JP 7-242376 9/1995
JP 7-252040 10/1995

* cited by examiner

*Primary Examiner*—Jonathan Salata
(74) *Attorney, Agent, or Firm*—Leydig Voit & Mayer, Ltd.

(57) ABSTRACT

An elevator control device includes: a convertor which rectifies a.c. power and converts the a.c. power into d.c. power; an inverter which converts the d.c. power into a.c. power having a variable voltage and a variable frequency; an electric motor which is driven by the a. c. power having a variable voltage and a variable frequency to operate an elevator; a power storing unit which is charged with electric power; a required-power arithmetically operating circuit which calculates power required by the elevator, which is an electric power required for the operation of the elevator or an electric power caused by the operation of the elevator; and a charging/discharging control circuit which controls charging and discharging of the power storing unit based on the power required by the elevator.

10 Claims, 9 Drawing Sheets

ELEVATOR CONTROL CALCULATING POWER CONSUMED AND POWER GENERATED BY A CONTROLLED ELEVATOR

BACKGROUND OF THE INVENTION

1. Field of the Invention

The present invention relates to an elevator control device using an electric power storing unit.

2. Description of the Related Art

An example of an elevator control device is shown in FIG. 10. FIG. 10 is a block diagram showing the structure of a conventional elevator control device.

Referring to FIG. 10, reference numeral 1 denotes a commercial three-phase a.c. power supply (hereinafter, referred to as "commercial power supply"), and 2 is an electric motor such as an induction motor. Reference numeral 3 denotes a winding machine which is connected to the electric power 2. Reference numeral 4 denotes a rope which is disposed on the winding machine 3. Reference numeral 5 denotes an elevator cage which is disposed on one end of the rope 4. Reference numeral 6 denotes a balance weight which is disposed on the other end of the rope 4.

The electric motor 2 is driven by the power supply from the commercial power supply 1, and the winding machine 3 is rotationally driven by driving the electric motor 2. Then, the rope 4 disposed around the winding machine 3 makes the elevator cage 5 and the balance weight 6 which are connected to each end of the rope 4, respectively, move so that a passenger within the cage 5 is carried to a desired floor.

Reference numeral 7 denotes a convertor which is made up of a diode or the like. The convertor 7 which is connected to the commercial power supply 1 rectifies an a.c. power supplied from the commercial power supply 1 so as to convert the a.c. power into a d.c.power. Referenc[0085] numeral 8 denotes an inverter which is made up of transistors, IGBTs and so on. Reference numeral 8 denotes an inverter which converts the d.c. power converted by the convertor 7 into an a.c. power having a variable voltage and a variable frequency. Reference numeral 9 denotes a regenerative resistor. Reference numeral 10 denotes a regenerative resistor control circuit which is connected in series to the regenerative resistor 9. The regenerative resistor 9 and the regenerative resistor control circuit 10 are disposed between the convertor 7 and the inverter 8.

Reference numeral 11 denotes a controller which decides the start/stop of the elevator and also produces a position/velocity command that commands the position and velocity of the elevator. Reference numeral 12 denotes a current detecting unit which is disposed between the electric motor 2 and the inverter 8. Reference numeral 13 denotes an encoder which is mounted on the winding machine 3. Reference numeral 14 denotes an inverter control circuit which allows the electric motor 2 to be rotationally driven by current feedback from the current detecting device 12 and speed feedback from the encoder 13 which are based on the position/velocity command from the controller 11, to thereby realize the position/velocity control of the elevator. Reference numeral 15 denotes a gate drive circuit that controls an output voltage and a frequency which are outputted from the inverter 8 on the basis of a signal from the inverter control circuit 14 to control the electric motor 2 and the elevator.

The balance weight 6 of the elevator is balanced with the cage 5 when an appropriate number of persons are in the cage 5. For example, in the case where the elevator travels and the balance weight 6 is balanced with the weight of the entire cage 5 including the passengers, although electric power is consumed at the time of acceleration, a kinetic energy can be returned to the electric power supply during deceleration. However, in a general elevator, the electric power obtained from the kinetic energy during deceleration is converted into thermal energy by the regenerative resistor 9 due to on/off switching of the regenerative resistor control circuit 10, thus being consumed.

As described, in the conventional elevator control device, unless the electric power is supplied from the commercial power supply 1, the elevator cannot be operated.

SUMMARY OF THE INVENTION

The present invention has been made in order to solve the above problem, and therefore an object of the present invention is to provide an elevator control device suppressing power supplied from a commercial power supply by using regenerative electric power from kinetic energy from regenerative operation when an elevator is decelerated.

In order to achieve the above object, according to the present invention, there is provided an elevator control device, comprising: a convertor which rectifies an a.c. power and converts the a.c. power into a d.c. power; an inverter which converts the d.c. power into an a.c. power having a variable voltage and a variable frequency; an electric motor which is driven by the a.c. power having a variable voltage and a variable frequency to drive an elevator; a power storing unit which is charged with an electric power; a required-power arithmetically operating circuit which calculates a required power of the elevator which is an electric power required for the operation of the elevator or an electric power caused by the operation of the elevator; and a charging/discharging control circuit which controls the charging operation or the discharging operation of the power storing unit based on the required power of the elevator.

Also, according to the present invention, there is provided the elevator control device further comprising a required-power arithmetically operating unit which calculates the required power of the elevator and outputs an obtained required-power value to a charging/discharging control unit through communication means.

Further, according to the present invention, there is provided the elevator control device in which the charging/discharging control circuit controls so that the electric power is charged in the power storing unit when a required power of the elevator is a negative value and an electric power occurs due to the operation of the elevator, and the electric power is discharged from the power storing unit when a required power of the elevator is a positive value and the electric power is required for the operation of the elevator.

Still further, according to the present invention, there is provided the elevator control device in which the charging/discharging control circuit controls so that the electric power is charged in the power storing unit from the commercial power supply when the required power of the elevator is 0 and the elevator stops.

Yet still further, according to the present invention, there is provided the elevator control device further comprising a charging/discharging circuit which conducts the charging operation or the discharging operation of the power storing unit under the control of the charging/discharging control circuit, wherein the charging/discharging control circuit controls the electric power discharged from the power storing unit on the basis of the required power of the elevator when the electric power of the elevator is a positive value and the electric power is required for the operation of the elevator, and controls an output voltage from the charging/discharging circuit to the power storing unit to a given voltage when the required power of the elevator is a negative value and the electric power occurs due to the operation of the elevator.

Yet still further, according to the present invention, there is provided the elevator control device in which the output voltage controlled to the given voltage which is outputted from the charging/discharging circuit is set to be higher than the voltage value obtained by rectifying the supply voltage.

Yet still further, according to the present invention, there is provided the elevator control device in which the charging/discharging control circuit controls so that the electric power is discharged from the power storing unit by an excessive electric power amount which exceeds a given electric power amount on the basis of the required power of the elevator.

Yet still further, according to the present invention, there is provided the elevator control device in which the charging/discharging control circuit controls the electric power amount discharged from the power storing unit on the basis of a predetermined time zone.

Yet still further, according to the present invention, there is provided the elevator control device in which the charging/discharging control circuit switches between a case in which only an excessive electric power amount which exceeds the predetermined electric power amount with respect to the required power of the elevator is discharged from the power storing unit, and a case in which the given electric power amount is stably discharged from the power storing unit.

Yet still further, according to the present invention, there is provided the elevator control device in which the required-power arithmetically operating circuit calculates the required power of the elevator on the basis of a voltage command value for applying the voltage to the electric power and an electric motor current or a current command value for supplying a current to the electric motor.

BRIEF DESCRIPTION OF THE DRAWINGS

These and other objects, features and advantages of this invention will become more fully apparent from the following detailed description taken with the accompanying drawings in which.

DETAILED DESCRIPTION OF THE PREFERRED EMBODIMENTS

Now, a description will be given in more detail of preferred embodiments of the present invention with reference to the accompanying drawings.

(First Embodiment)

Figure 1:
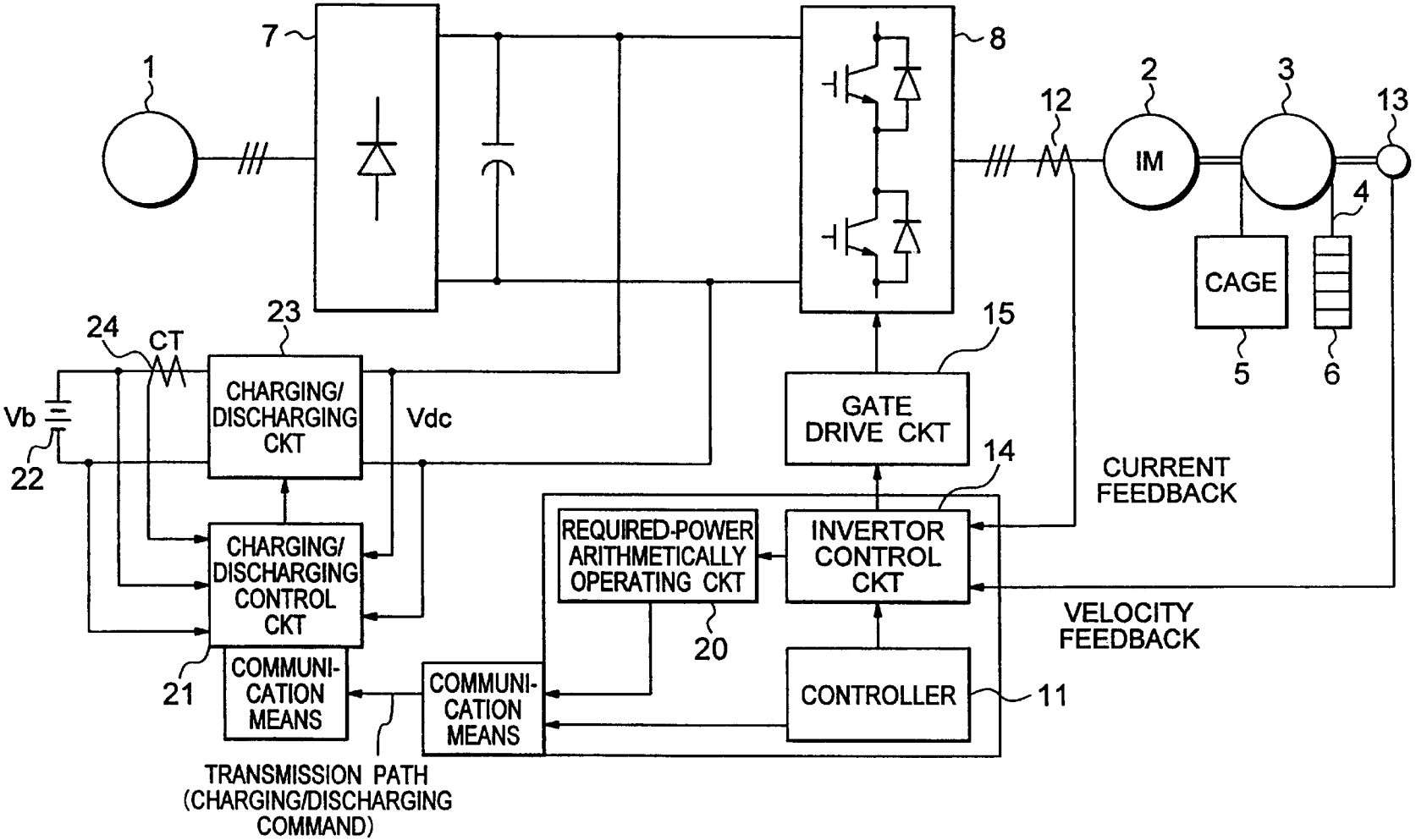
FIG. 1 is a block diagram showing the structure of an elevator control device in accordance with a first embodiment of the present invention.

An elevator control device in accordance with an embodiment of the present invention will be described with reference to FIG. 1. FIG. 1 is a block diagram showing the structure of an elevator control device in accordance with a first embodiment of the present invention.

Referring to FIG. 1, reference numeral 20 denotes a required-power arithmetically operating circuit which is connected to an inverter control circuit 14 and calculates a required power of the elevator. Reference numeral 21 denotes charging/discharging control circuit.

The required-power arithmetically operating circuit 20 constitutes one drive control unit in association with the inverter control circuit 14 and the controller 11, and a control command and an arithmetically operated result which are outputted from the controller 11 and the required-power arithmetically operating circuit are inputted to communication means disposed in the drive control unit. The control command outputted from the controller 11 includes a velocity command, a stop-time charging current command, a charging/discharging command and so on.

The charging/discharging control circuit 21 includes communication means, similarly, and a control command and an arithmetically operated result which are outputted from the communication means of the drive control unit are inputted to the communication means of the charging/discharging control circuit 21 through a serial or parallel transmission path.

Reference numeral 22 denotes a power storing unit which is made up of a battery or the like. Reference numeral 23 denotes a charging/discharging circuit which is made up of a DC/DC convertor or the like. Then, the charging/discharging circuit 23 is connected to the power storing unit 22 and a bus. The bus is directed to a connection between the convertor 7 and the inverter 8.

The charging/discharging control circuit 21 detects a voltage across the charging/discharging circuit 23 at the power storing unit 22 side and voltage across the charging/discharging circuit 23 at the bus side. Also, the charging/discharging control circuit 21 controls the electric power charged in the power storing unit 22 due to the charging/discharging circuit 23 and the electric power discharged from the power storing unit 22.

Reference numeral 24 denotes a charging/discharging current detector (CT) which is disposed between the power storing unit 22 and the charging/discharging circuit 23. The charging/discharging current detector 24 detects a current value between the power storing unit 22 and the charging/discharging circuit 23, that is, a current value of a current charged in the power storing unit 22 and a current value of a current discharged from the power storing unit 22 and notifies the charging/discharging control circuit 21 of those current values.

Figure 10:
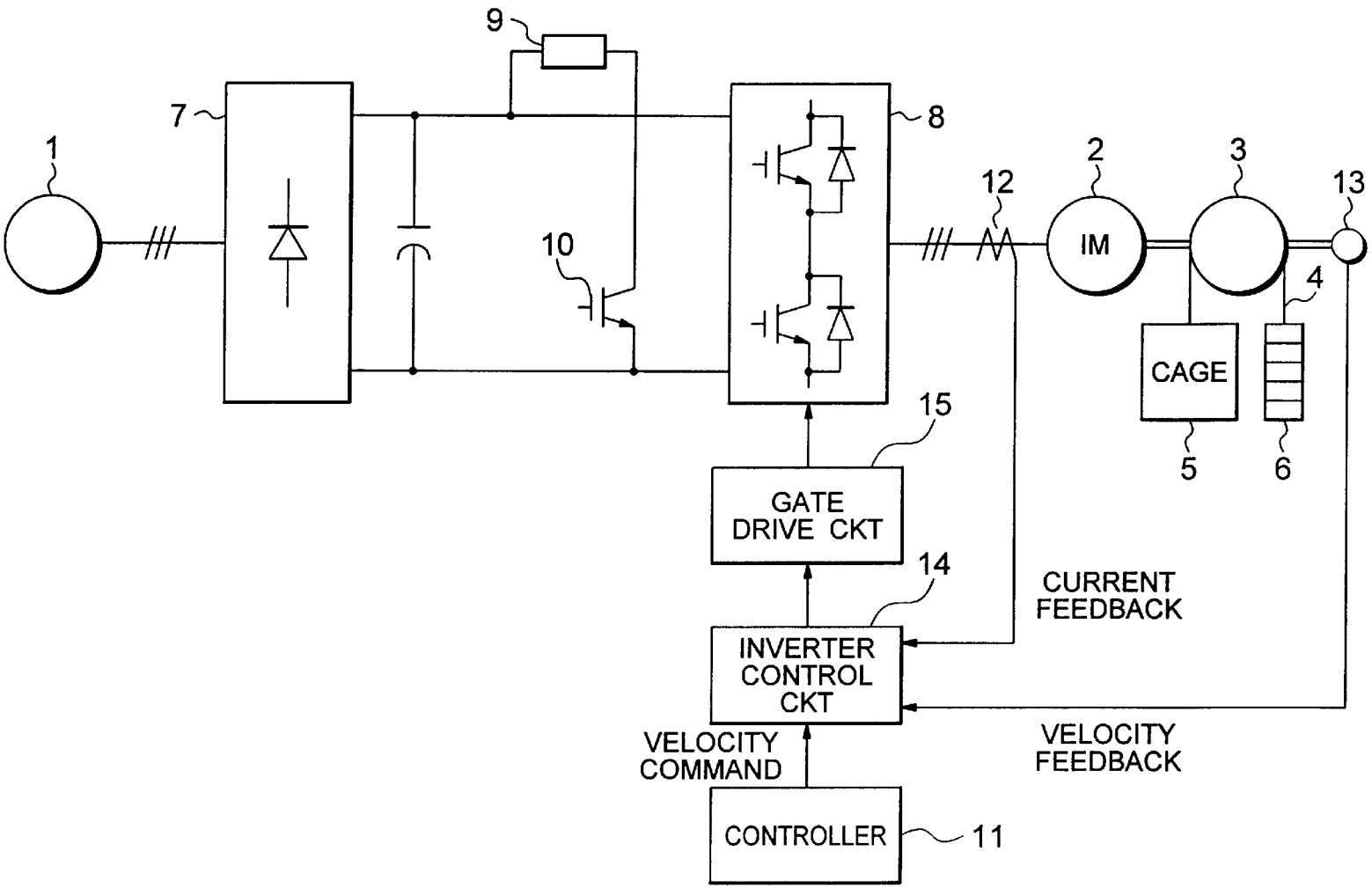
FIG 10 is a block diagram showing the structure of a conventional elevator control device.

In FIG. 1, parts identical with or corresponding to those in the conventional example shown in FIG. 10 are designated by the same references and the description thereof is omitted, and parts different from FIG. 10 are described.

Figure 2:
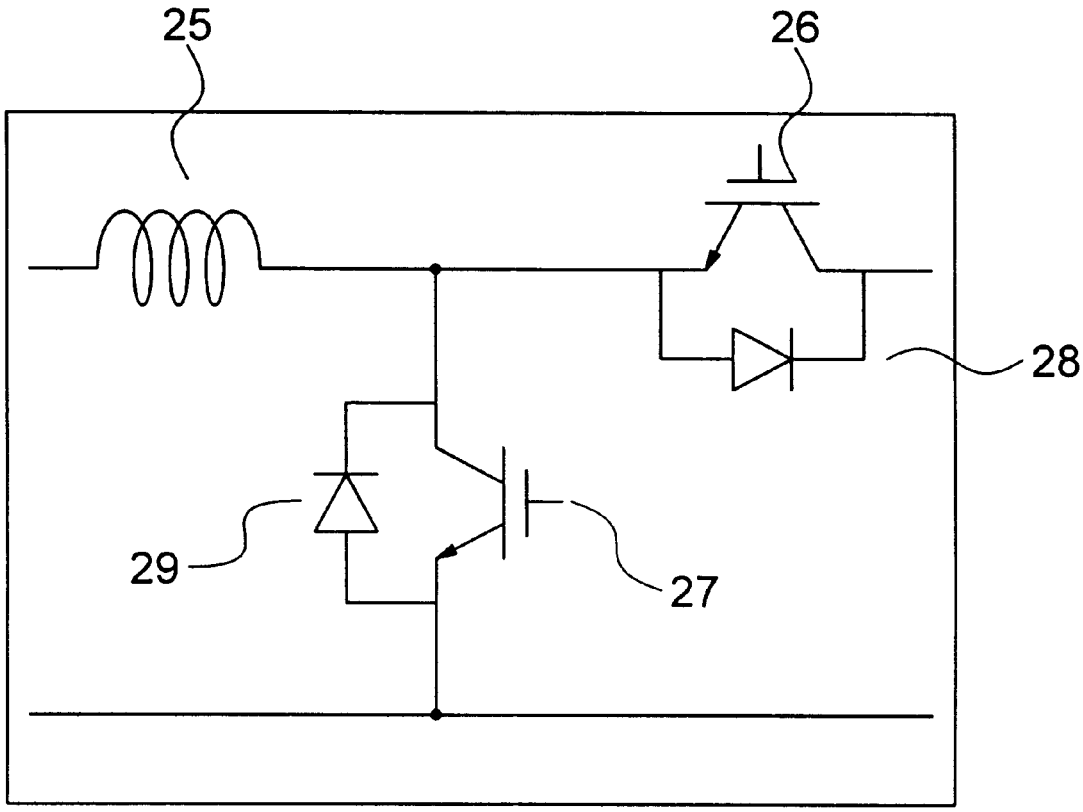
FIG. 2 is a circuit diagram showing the circuit structure of a charging/discharging circuit in the elevator control circuit in accordance with the first embodiment of the present invention.

Subsequently, the charging/discharging circuit 23 in the elevator control device in accordance with the first embodiment shown in FIG. 1 will be described with reference to FIG. 2. FIG. 2 is a circuit diagram showing the circuit structure of the charging/discharging circuit 23 in the elevator control circuit in accordance with the first embodiment.

Referring to FIG. 2, reference numeral 25 denotes a reactor, 26 and 27 are switching elements such as IGBTs and 28 and 29 are diodes. The reactor 25 is connected in series to the switching element 26. Also, the reactor 25 is connected in series to the switching element 27. Further, the switching element 26 is connected inversely in parallel with the diode 28, and the switching element 27 is connected inversely in parallel with the diode 29. In addition, charging of the electric power in the power storing unit 22 is conducted by a step-down chopper circuit consisting of the reactor 25, the switching element 26 and the diode 29. Also, discharging of the electric power from the power storing unit 22 is conducted by a step-up chopper circuit consisting of the reactor 25, the switching element 27 and the diode 28.

Figure 3:
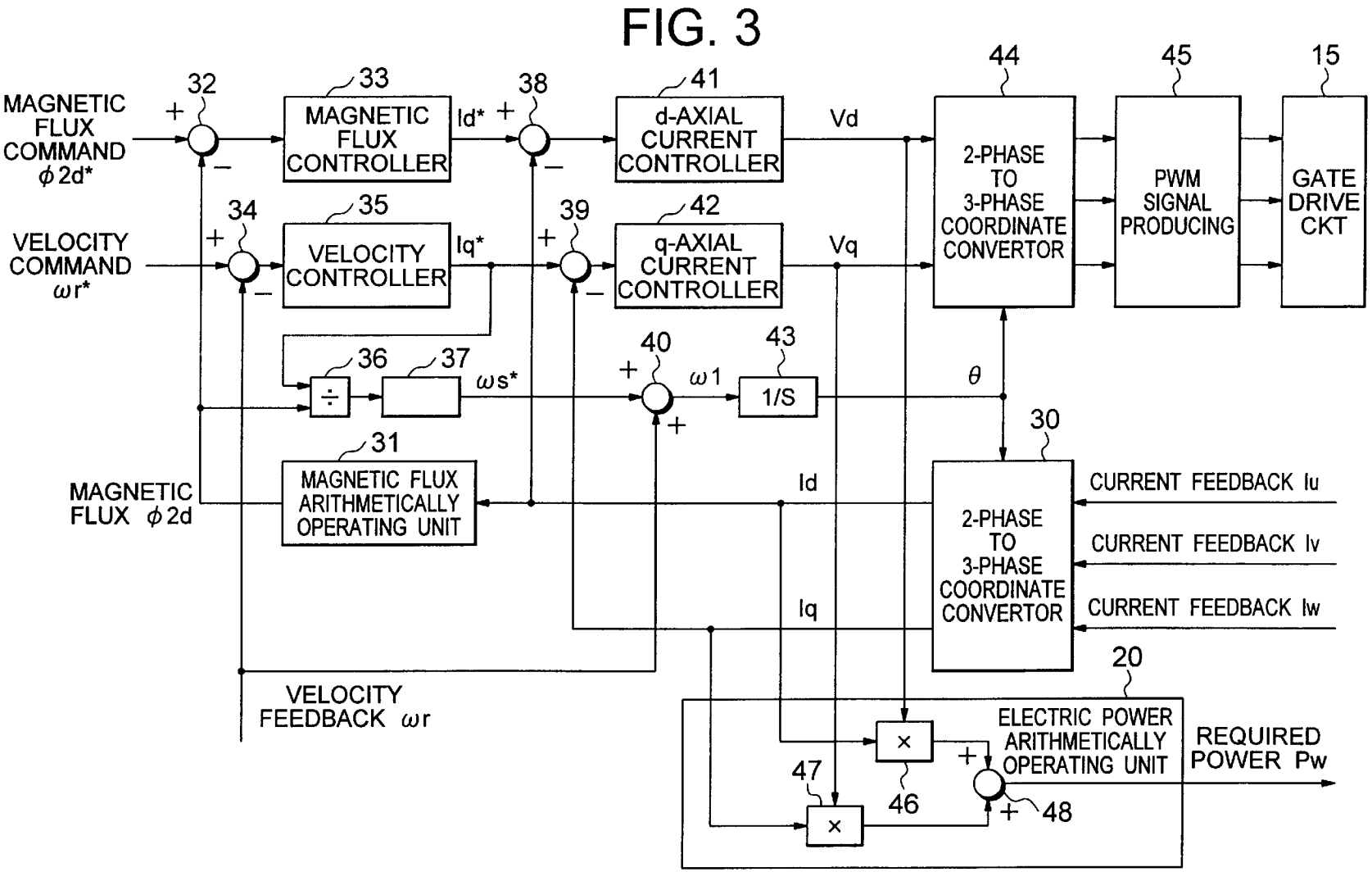
FIG. 3 is a block diagram showing the structure of an inverter control circuit and a required-power arithmetically operating circuit in the elevator control circuit in accordance with the first embodiment of the present invention.

Subsequently, the inverter control circuit 14 and the required-power arithmetically operating circuit 20 provided in the elevator control device in accordance with the first embodiment of the present invention will be described with reference to FIG. 3. FIG. 3 is a block diagram showing the structure of the inverter control circuit 14 and the required-power arithmetically operating circuit 20 in the elevator control circuit in accordance with this embodiment.

Referring to FIG. 3, reference numeral 30 denotes a three-phase to two-phase coordinate convertor. The three-phase to two-phase coordinate convertor 30 converts current feedbacks Iu, Iv and Iw of a three-phase a.c. current detected by the current detecting unit 12 into stator winding currents Id and Iq. The stator winding currents Id and Iq are values in a biaxial rotatory coordinate system (d-q coordinate system) which rotates in synchronism with a frequency ω1 of an a.c. voltage which is applied to the stator winding.

Reference numeral 31 denotes a magnetic flux arithmetically operating unit which inputs the stator winding current Id in the d-q coordinate system outputted from the three-phase to two-phase coordinate convertor 30 and outputs a magnetic flux Φ2*d* which interlinks with the rotary. Reference numeral 32 denotes a subtractor which inputs the magnetic flux Φ2*d* outputted from the magnetic flux arithmetically operating unit 31 and the magnetic flux command Φ2*d* *. Reference numeral 33 denotes a magnetic flux controller which inputs the output value outputted from the subtractor 32 and controls the d-axial component magnetic flux Φ2*d* of the rotary winding interlinked magnetic flux to a desired value magnetic flux command Φ2*d* *. Reference numeral 34 denotes a subtractor which inputs the velocity feedback ωr outputted from the encoder 13 and the velocity commander ωr* outputted from the controller 11. Reference numeral 35 denotes a velocity controller which inputs an output value from the subtractor 34 and controls a rotary angular velocity ωr to a desired value orω*. Reference numeral 36 denotes a divider which inputs the magnetic flux Φ2*d* outputted from the magnetic flux arithmetically operating unit 31 and the output value outputted from the velocity controller 35.

Reference numeral 37 denotes a coefficient multiplie which outputs a sliding frequency command ωs* on the basis of an output value outputted from the divider 36. Reference numeral 38 denotes a subtractor which inputs the stator winding current Id outputted from the three-phase to two-phase coordinate convertor 30 and the output value outputted from the magnetic flux controller 33. Reference numeral 39 denotes a subtractor which inputs the stator winding current Iq outputted from the three-phase to two-phase coordinate convertor 30 and the output value outputted from the velocity controller 35. Reference numeral 40 denotes an adder which inputs the sliding frequency command ωs* outputted from the coefficient multiplier 37 and the velocity feedback or outputted from the encoder 13.

Reference numeral 41 denotes a d-axial current controller which inputs the output value outputted from the subtractor 38 and, for example, proportionally integrates a difference between the d-axial component command value Id* of the stator winding current and its actual value Id to control the d-axial current to a command value. Reference numeral 42 denotes a q-axial current controller which inputs the output value outputted from the subtractor 39 and, for example, proportionally integrates a difference between the q-axial component command value Iq* of the stator winding current and its actual value Iq to control the q-axial current to a command value.

Reference numeral 43 denotes an integrator which inputs the output value outputted from the adder 40. Reference numeral 44 denotes a two-phase to three-phase coordinate convertor which inputs the output value outputted from the d-axial current controller 41, the output value outputted from the q-axial current controller 42 and the output value outputted from the integrator 43 to convert the voltage command values Vd and Vq in the d-q coordinate system into a three-phase a.c. voltage command value. The output value outputted from the integrator 43 is also inputted to the three-phase to two-phase coordinate convertor 30. Reference numeral 45 denotes a PWM signal producing circuit which inputs the output value outputted from the two-phase to three-phase coordinate convertor 44. A gate drive circuit 15 inputs the output value outputted from the PWM signal producing circuit 45.

Reference numeral 46 denotes an integrator which inputs the output value outputted from the d-axial current controller 41 and the stator winding current Id outputted from the three-phase to two-phase coordinate convertor 30. The output value outputted from the d-axial current controller 41 is the voltage command value Vd in the d-q coordinate system. Reference numeral 47 denotes an integrator which inputs the output value outputted from the qaxial current controller 42 and the stator winding current Iq outputted from the three-phase to two-phase coordinate convertor 30. The output value outputted from the q-axial current controller 42 is the voltage command value Vq in the d-q coordinate system.

Reference numeral 48 denotes an adder which inputs the output value outputted from the integrator 46 and the output value outputted from the integrator 47 and outputs the required power value Pw of the elevator. The required-power arithmetically operating circuit 20 includes the integrator 46, the integrator 47 and the adder 48.

In order to obtain the required power value Pw of the elevator, there is another case in which the integrator 46 arithmetically operates the voltage command value Vd and the stator winding current command value Id* in the d-q coordinate system, the integrator 47 arithmetically operates the voltage command value Vq and the stator winding current command value Iq* in the d-q coordinate system, and the adder 48 arithmetically operate the output from the integrator 46 and the output from the integrator 47.

Also, the stator winding current Id and the stator winding current Iq correspond to the electric power current, and the stator winding current command value Id* and the stator winding current command value Iq* correspond to the current command value.

Figure 4:
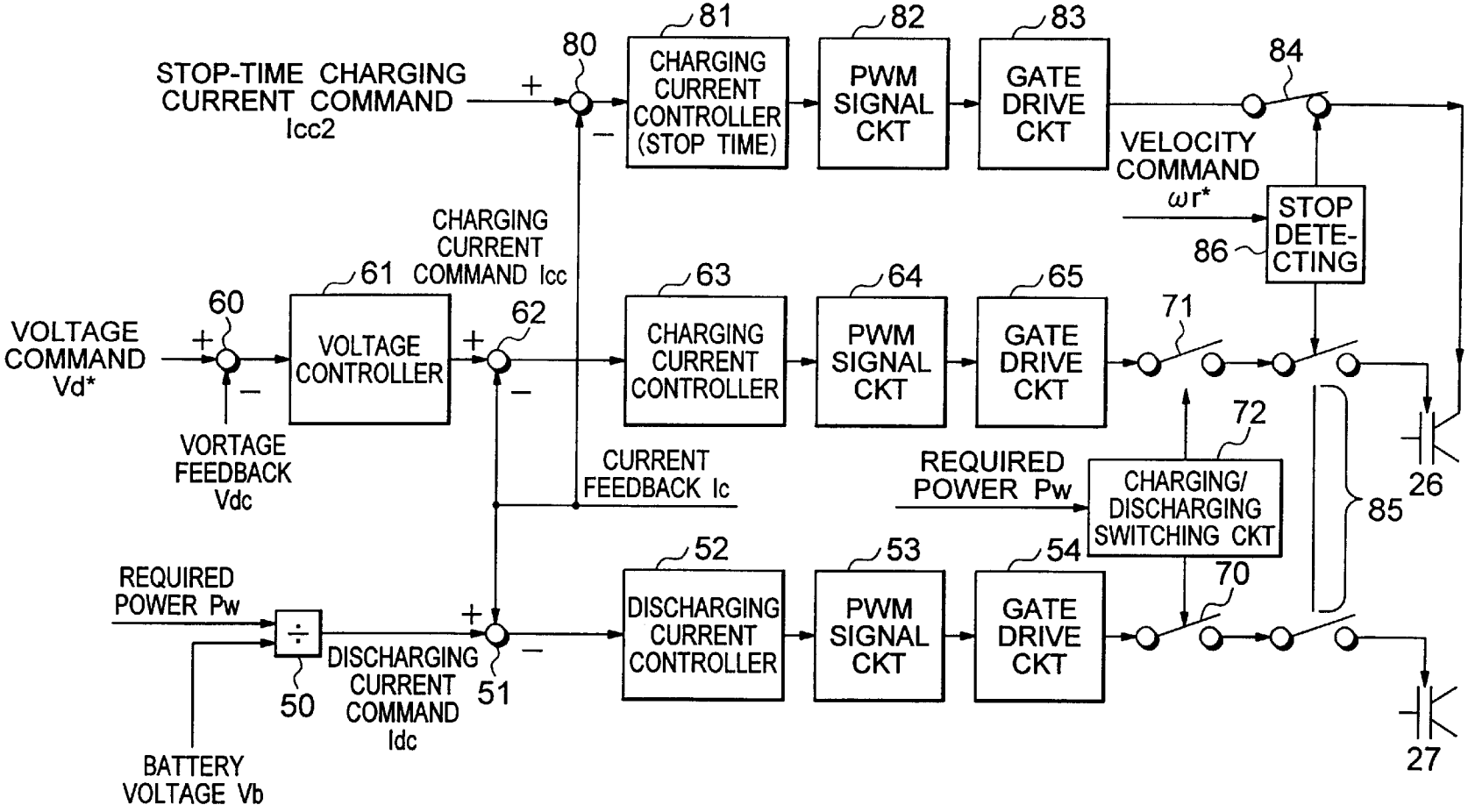
FIG. 4 is a block diagram showing the structure of a charging/discharging circuit in the elevator control circuit in accordance with the first embodiment of the present invention.

Subsequently, the charging/discharging control circuit 21 provided in the elevator control device in accordance with the first embodiment shown in FIG. 1 will be described with reference to FIG. 4. FIG. 4 is a block diagram showing the structure of the charging/discharging circuit 21 in the elevator control circuit in accordance with this embodiment.

Referring to FIG. 4, reference numeral 50 denotes a divider which inputs the required power value Pw outputted from the required-power arithmetically operating circuit 20 and the battery voltage Vb of the power storing unit 22.

Reference numeral 51 denotes a subtractor which inputs a discharge current command Idc outputted from the divider 50 and a current feedback Ic detected by the charging/discharging current detector 24. Reference numeral 52 denotes a discharge current controller which inputs the output value outputted from the subtractor 51 and, for example, proportionally operates a difference between the discharging current command value Idc and the charging/discharging current Ic which is its actual value to control the discharging current command value Idc. The current feedback Ic and the charging/discharging current Ic are identical with each other. Reference numeral 53 denotes a PWM signal circuit which inputs the output value outputted from the discharging current controller 52 to produce PWM modulated signal. Reference numeral 54 denotes a gate drive circuit which inputs the PWM modulated signal outputted from the PWM signal circuit 53.

Reference numeral 60 denotes a subtractor which inputs the voltage feedback Vdc of a d.c. voltage detected at the output terminal of the charging/discharging circuit 23 and the voltage command Vdc*. Reference numeral 61 denotes a voltage controller which inputs the output value outputted from the subtractor 60 and, for example, proportionally integrates a difference between the voltage command value Vdc* and its actual value Vdc to control the voltage command value Vdc*. Reference numeral 62 denotes a subtractor which inputs the charging current command Icc outputted from the voltage controller 61 and the current feedback Ic detected by the charging/discharging current detector 24. Reference numeral 63 denotes a charging current controller which inputs the output value outputted from the subtractor 62 and, for example, proportionally integrates a difference between the charging current command value Icc and the charging/discharging current Ic detected by the charging/discharging current detector 24 which is its actual value to control the charging current command value Icc. Reference numeral 64 denotes a PWM signal circuit which inputs the output value outputted from the charging current controller 63 to produce the PWM modulated signal. Reference numeral 65 denotes a gate drive circuit which inputs the PWM modulated signal outputted from the PWM signal circuit 64.

Reference numeral 70 denotes a switch which is connected to the gate drive circuit 54. Reference numeral 71 denotes a switch which is connected to the gate driver circuit 65.

The divider 50, the subtractor 51, the discharging current controller 52, the PWM signal circuit 53, the gate drive circuit 54 and the switch 70 constitute a discharging control circuit.

Also, the subtractor 60, the voltage controller 61, the subtractor 62, the charging current controller 63, the PWM signal circuit 64, the gate drive circuit 65 and the switch 71 constitute a charging control circuit.

Reference numeral 72 denotes a charging/discharging switching circuit which inputs a required power value Pw outputted from the required-power arithmetically operating circuit 20 to switch the on/off operation of the switch 70 in the discharging control circuit and the switch 71 in the charging control circuit. The switch 70 and the switch 71 conduct the open/close operation in response to a command from the charging/discharging switching circuit 72 to interlock with each other.

Reference numeral 80 denotes a subtractor which inputs the stop-time charging current command Icc2 outputted from the controller 11 and the current feedback Ic detected by the charging/discharging current detector 24. Reference numeral 81 denotes a stop-time charging current controller which inputs the output value outputted from the subtractor 80 and, for example, proportionally integrates a difference between the stop-time charging current command value Icc2 and its actual value Ic to control the stop-time charging current command value Icc2. Reference numeral 82 denotes a PWM signal circuit which inputs the output value outputted from the charging current controller 111 and produces a PWM modulated signal. Reference numeral 83 denotes a gate drive circuit which inputs the PWM modulated signal outputted from the PWM signal circuit 82.

Reference numeral 84 denotes a switch which is connected to the gate drive circuit 83. The subtractor 80, the charging current controller 111, the PWM signal circuit 82, the gate drive circuit 83 and the switch 84 constitute a stop-time charging control circuit.

Reference numeral 85 denotes a switch which is connected to the switch 71 and the switch 70. The discharging control circuit, the charging control circuit and the switch 85 constitute a charging/discharging control circuit.

Reference numeral 86 denotes a stop detecting circuit which inputs a velocity command ωr* outputted from the controller 11 and switches the on/off operation of the switch 84 in the stop-time charging control circuit and the switch 85 in the charging/discharging control circuit in response to the inputted velocity command. The switch 84 and the switch 85 conduct the open/close operation in response to a command from the stop detecting circuit 86 to interlock with each other.

When the switch 84 is turned on, the switching element 26 is operated to conduct the charging of the electric power in the power storing unit 22. Also, when the switch 85 is turned on and the switch 70 is turned on, the switching element 27 is operated to conduct the discharging of the electric power from the power storing unit 22. In addition, when the switch 85 is turned on and the switch 71 is turned on, the switching element 26 is operated to conduct the charging of the electric power in the power storing unit 22.

Also, when the stop detecting circuit 86 judges that the operation of the elevator stops when the inputted velocity command ωr* is 0, and turns on the switch 84 but turns off the switch 85.

Further, the input signal to the stop detecting circuit 86 may be of a direct start/stop signal from the elevator control device instead of the velocity command ωr*, or the required power value Pw may be 0.

Figure 5:
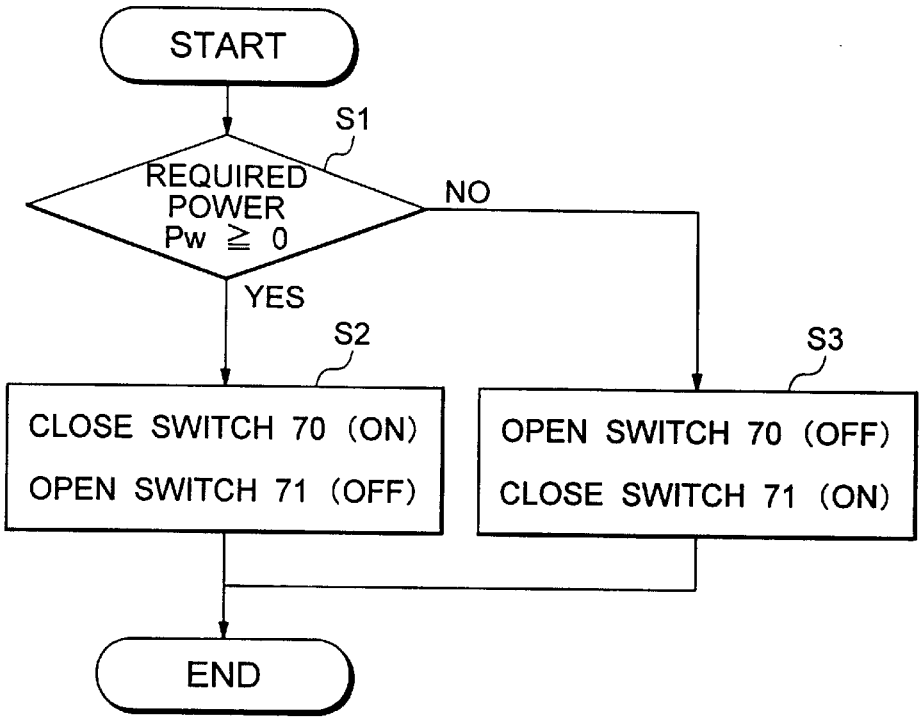
FIG. 5 is a flowchart showing the operation of a charging/discharging switching circuit in the elevator control circuit in accordance with the first embodiment of the present invention.

Subsequently, the operation of the charging/discharging switching circuit 72 provided in the elevator control device in accordance with the first embodiment shown in FIG. 1 will be described with reference to FIG. 5. FIG. 5 is a flowchart showing the operation of the charging/discharging switching circuit 72 in the elevator control circuit in accordance with this first embodiment.

Referring to FIG. 5, in Step (hereinafter referred to as "S") 1, the charging/discharging switching circuit 72 judges whether the required power value Pw is 0 or more, or not. If the required power value Pw is 0 or more, the operation proceeds to S2. If the required power value Pw is less than 0, the operation proceeds to S3.

In S2, the charging/discharging switching circuit 72 turns off the switch 71 to shut out the charging control circuit and turns on the switch 70 to render the discharging control circuit conductive, thereby discharging the electric power from the power storing unit 22.

In S3, the charging/discharging switching circuit 72 turns off the switch 70 to shut out the discharging control circuit and turns on the switch 71 to render the charging control circuit conductive, thereby charging the electric power in the power storing unit 22.

Figure 6:
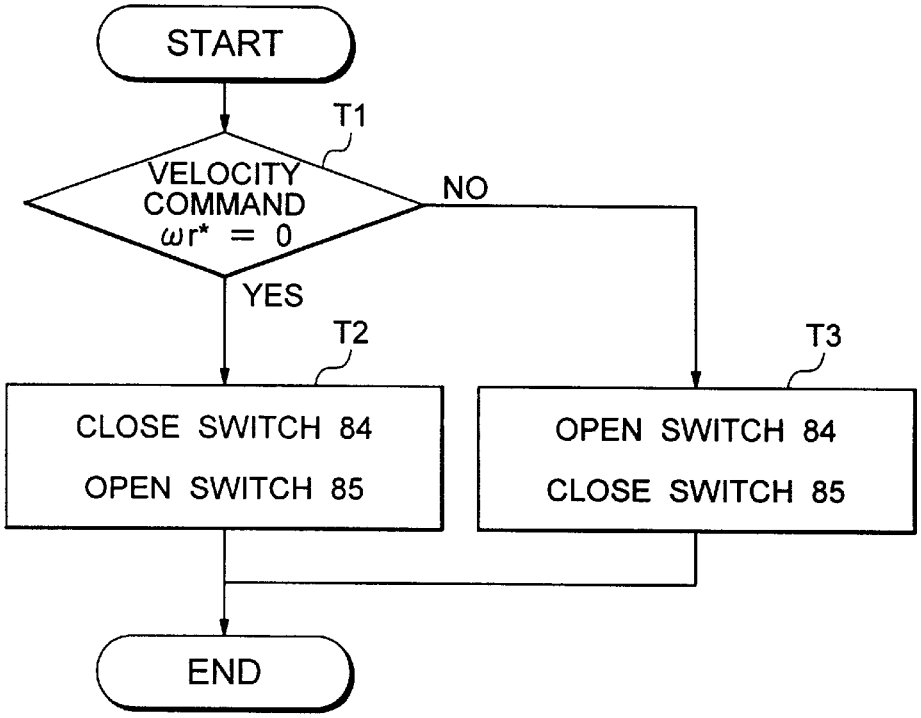
FIG. 6 is a flowchart showing the operation of a stop detecting circuit in the elevator control circuit in accordance with the first embodiment of the present invention.

Subsequently, the operation of the stop detecting circuit 86 provided in the elevator control device in accordance with the first embodiment shown in FIG. 1 will be described with reference to FIG. 6. FIG. 6 is a flowchart showing the operation of the stop detecting circuit 86 in the elevator control circuit in accordance with this embodiment.

Referring to FIG. 6, in Step (hereinafter referred to as "T") 1, the stop detecting circuit 86 judges whether the velocity command ω r* is 0 or more, or not. If the velocity command ωr* is 0, that is, if the elevator stops, the operation proceeds to T2. If the velocity command ωr* is not 0, that is, if the elevator does not stop, the operation proceeds to T3.

In T2, the stop detecting circuit 86 turns off the switch 85 to shut out the charging/discharging control circuit and turns on the switch 84 to render the stop-time charging control circuit conductive, thereby charging the electric power in the power storing unit 22 from the commercial power supply 1.

In T3, the stop detecting circuit 86 turns off the switch 84 to shut out the stop-time charging control circuit and turns on the switch 85 to render the charging/discharging control circuit conductive. Upon completion of this processing, the processing of the above-described S1 may be executed.

The stop-time charging control circuit can charge the power storing unit 22 with the electric power from the commercial power supply 1 with precision by controlling the charging current by the stop-time charging current controller 111 on the basis of the stop-time charging current command Icc 2.

Subsequently, the operation of the elevator control device in accordance with the first embodiment shown in FIG. 1 will be described.

The elevator is operated under the control of the inverter control circuit 14 based on the position/velocity command from the controller 11. Also, the required-power arithmetically operating circuit 20 arithmetically operates the required power value Pw of the elevator under the control of the inverter control circuit 14 and outputs the required power value Pw to the charging/discharging control circuit 21. Then, the charging/discharging control circuit 21 to which the required power value Pw has been inputted controls the charging/discharging operation with respect power storing unit 22.

For example, if the required power value Pw is negative, that is, if the elevator is at the time of regenerative running, the charging control circuit within the charging/discharging control circuit 21 operates, and the regenerative electric power obtained by the regenerative operation of the elevator is charged in the power storing unit 22. The voltage of the charging control circuit within the charging/discharging control circuit 21 is controlled by the voltage controller 61 upon input of a given voltage command Vdc*, and its charging current is controlled by the charging current controller 63. Under those controls, the regenerative power caused by the regenerative operation of the elevator is charged in the power storing unit 22 with precision. The given voltage command Vdc* means a voltage higher than the voltage obtained by rectifying the supply voltage.

Also, if the required power value Pw is positive, that is, if the elevator is at the time of power running, the discharging control circuit within the charging/discharging control circuit 21 operates, and the electric power necessary for the power running of the elevator is discharged from the power storing unit 22. The discharging control circuit within the charging/discharging control circuit 21 inputs the required power value Pw outputted from the required-power arithmetically operating circuit 20 and the battery voltage value Vb and outputs the discharging current command Idc that satisfies Expression (1).

$$Idc=Pw/Vb \tag{1}$$

Then, the discharging current command Idc is inputted to the discharging current controller 52 together with the discharging current value Ic detected by the charging/discharging current detector 24, to thereby control the discharging current value. Under the above control, the discharging of the electric power from the power storing unit 22 is controlled.

Further, if the required power value Pw is 0, that is if the elevator stops, the stop-time charging control circuit within the charging/discharging control circuit 21 operates, and the electric power supplied from the commercial power supply 1 is charged in the power storing unit 22. The judgment that the elevator stops is not always based on the velocity command ωr*. Also, the charging current which flows in the stop-time charging control circuit within the charging/discharging control circuit 21 is controlled by the stop-time charging current controller 111 according to the stop-time charging current command value Icc2. Under the above control, the electric power supplied from the commercial power supply 1 is charged in the power storing unit 22 with precision.

As described above, in the elevator control device according to this embodiment, because the power storing unit 22 is provided so as to charge the regenerative power produced at the time of representative running of the elevator therein, the electric power charged in the power storing unit 22 can be employed at the time of the power running of the elevator after then. Also, the regenerative power which has been conventionally uselessly consumed by the regenerative resistor 9 or the like can be effectively utilized, the electric power can be employed with high efficiency and with a high energy saving effect, and the power supply amount from the commercial power supply 1 can be suppressed.

In general, the electric power demand for the commercial power supply 1 becomes peak afternoon of a summer hot day, and the energy consumption during that time zone is required to be reduced. Even under the circumstance, the elevator control device according to this embodiment can reduce the energy consumption from the commercial power supply 1 during the time zone where the energy consumption is required to be reduced by using the power storing unit 22 which is charged with the regenerative power or the like.

Also, a period of time when the elevator stops is long, and its average energy consumption is small. However, an instantaneous power consumption (hereinafter referred to as "instantaneous power") required for the operation is large, and a temporal variation of the power consumption is large. For that reason, in the conventional elevator control device having no power storing unit 22, the energy must be supplied from the commercial power supply 1 in conformity with the large instantaneous power, but the large instantaneous power is not required during much time zone, resulting in much uselessness.

However, in the elevator control device according to this embodiment, because the power storing unit 22 is provided, the electric power demanded for the operation of the elevator is supplied by the electric power supplied from the commercial power supply 1 and the electric power supplied from the power storing unit 22. Then, the power supply amount from the commercial power supply 1 is suppressed to the average energy consumption of the elevator, the energy consumption having a level which is generally much used, or the like, so that the energy supplied from the commercial power supply 1 can be suppressed to an appropriate supply energy necessary during much time zone. In other words, it is possible to set an electric power contracted with an electric power company to be low, and the operating costs of the elevator becomes inexpensive. The electric power which is instantaneously lack is supplemented by the power storing unit 22.

On the other hand, since all the electric power necessary for the operation of the elevator is not supplied from the power storing unit 22, the costs for the power storing unit 22 can be also suppressed.

Also, the charging of the electric power in the power storing unit 22 is conducted by using not only the regenerative power but also the commercial power supply 1 during the stoppage of the elevator, the supplied electric power can be more effectively utilized.

(Second Embodiment)

An elevator control device according to another embodiment of the present invention will be described. The structure of the elevator control device according to this embodiment is identical with the structure of the elevator control device according to the first embodiment shown in FIG. 1, and therefore its description will be omitted. Also, the circuit structure of the charging/discharging circuit provided in the elevator control device according to this embodiment is identical with the circuit structure of the charging/discharging circuit 23 provided in the elevator control device according to the first embodiment shown in FIG. 2, and therefore its description will be omitted. Further, the structure of the inverter control circuit and the required-power arithmetically operating circuit provided in the elevator control device according to this embodiment is identical with the structure of the inverter control circuit 14 and the required-power arithmetically operating circuit 20 provided in the elevator control device according to the first embodiment shown in FIG. 3, and therefore its description will be omitted.

Figure 7:
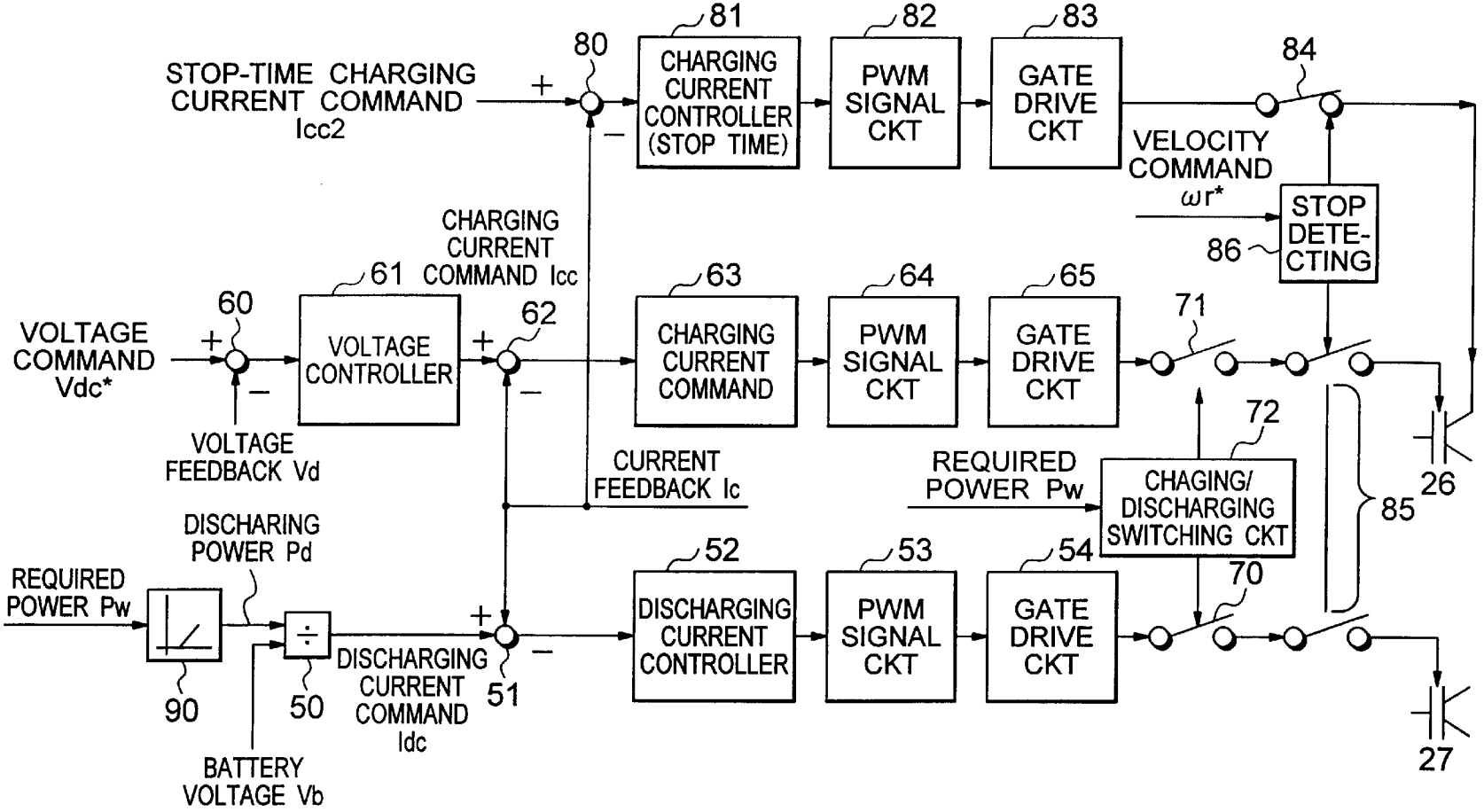
FIG. 7 is a block diagram showing the structure of a charging/discharging circuit in an elevator control circuit in accordance with a second embodiment of the present invention.

Then, the charging/discharging control circuit provided in the elevator control device according to this embodiment will be described with reference to FIG. 7. FIG. 7 is a block diagram showing the structure of a charging/discharging circuit in an elevator control circuit in accordance with this embodiment.

Referring to FIG. 7, reference numeral 90 denotes a non-linear element section which is connected to the subtractor 50. The non-linear element section 90 inputs the required power value Pw outputted from the required-power arithmetically operating circuit 20 and outputs a remaining difference value obtained by subtracting a given power value from the required power value Pw.

In FIG. 7, parts identical with or corresponding to those in the first embodiment shown in FIG. 4 are designated by the same references, and the description thereof is omitted and parts different from FIG. 4 are described.

Subsequently, the operation of the elevator control device according to the second embodiment will be described. If the required power value Pw inputted to the charging/discharging control circuit 21 is 0 or less, the operation of the elevator control device according to this embodiment is identical with the operation of the elevator control device described in the first embodiment, and therefore its description will be omitted.

If the required power value Pw is positive, that is, if the elevator is at the time of power running, the discharging control circuit within the charging/discharging control circuit 21 operates. Then, the remaining from which the given power value set on the non-linear element section 90 out of the required power value Pw necessary for the power running of the elevator is subtracted, that is, an excessive amount of the given power value set on the non-linear element section 90 is discharged from the power storing unit 22.

The given power value set on the non-linear element section 90 is a given power value within an electric power contracted with an electric power company. Also, the non-linear element section 90 of the discharging control circuit within the charging/discharging control circuit 21 according to this embodiment inputs the required power value Pw arithmetically operated by the required-power arithmetically operating circuit 20 and outputs the remaining difference value obtained by subtracting the above-described given power value from the required power value Pw to the divider 50 as the discharging power value Pd. Then, the divider 50 inputs the discharging power value Pd and the battery voltage value Vb to produce the discharging current command Idc which satisfies Expression (2).

$$Idc=Pd/Vb \tag{2}$$

Then, the discharging current command Idc produced in the divider 50 is inputted to the discharging current controller 52 together with the discharging current value Ic detected by the charging/discharging current detector 24, to thereby control the discharging current value discharged from the power storing unit 22.

(Third Embodiment)

An elevator control device according to still another embodiment of the present invention will be described. The structure of the elevator control device according to this embodiment is identical with the structure of the elevator control device according to the first embodiment shown in FIG. 1, and therefore its description will be omitted. Also, the circuit structure of the charging/discharging circuit provided in the elevator control device according to this embodiment is identical with the circuit structure of the charging/discharging circuit 23 provided in the elevator control device according to the first embodiment shown in FIG. 2, and therefore its description will be omitted. Further, the structure of the inverter control circuit and the required-power arithmetically operating circuit provided in the elevator control device according to this embodiment is identical with the structure of the inverter control circuit 14 and the required-power arithmetically operating circuit 20 provided in the elevator control device according to the first embodiment shown in FIG. 3, and therefore its description will be omitted.

Figure 8:
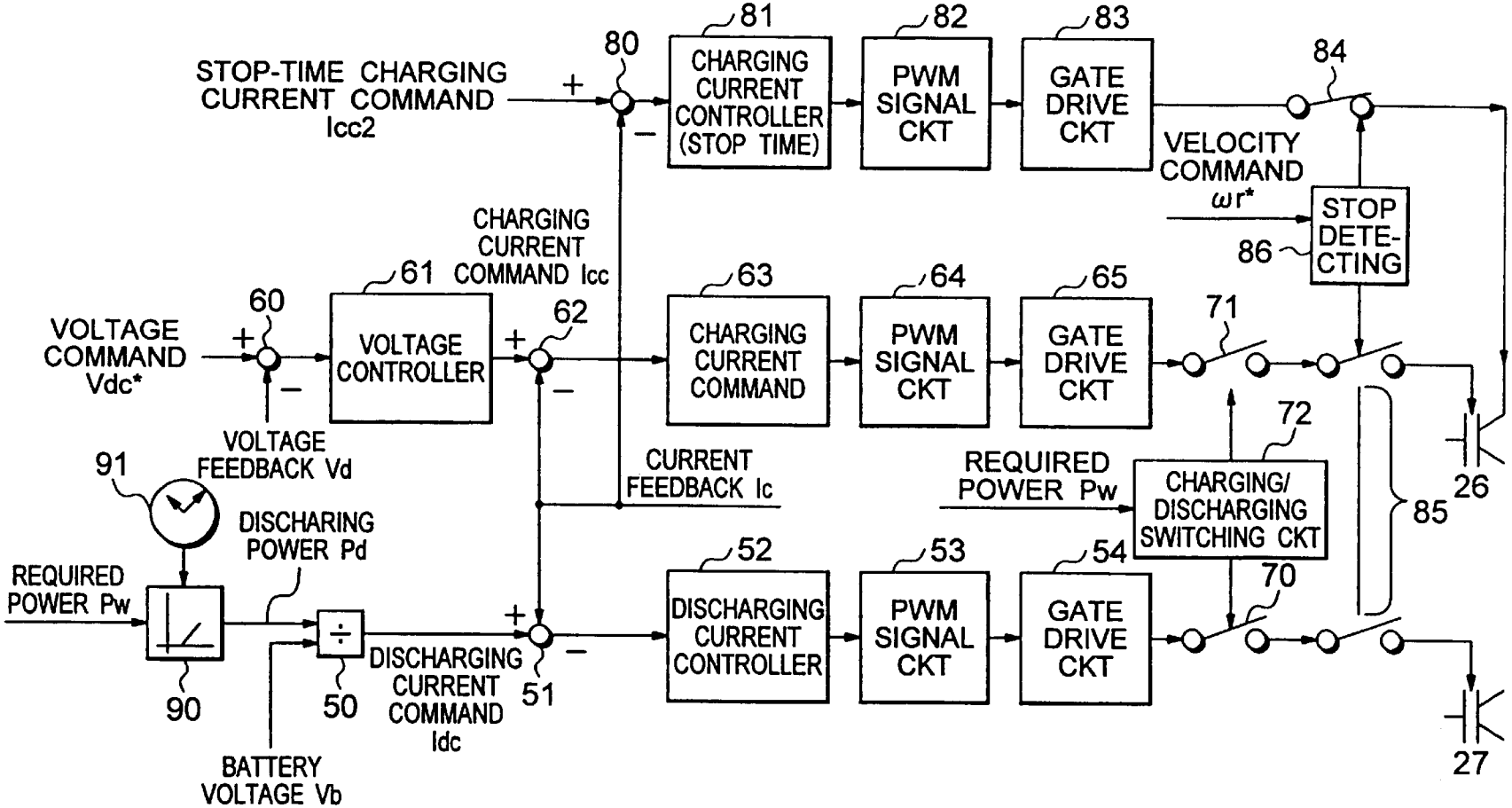
FIG. 8 is a block diagram showing the structure of a charging/discharging circuit in an elevator control circuit in accordance with a third embodiment of the present invention.

Then, the charging/discharging control circuit provided in the elevator control device according to this embodiment will be described with reference to FIG. 8. FIG. 8 is a block diagram showing the structure of a charging/discharging circuit in an elevator control circuit in accordance with this embodiment.

Referring to FIG. 8, reference numeral 91 denotes a clock which is connected to the non-linear element section 90.

In FIG. 8, parts identical with or corresponding to those in the second embodiment shown in FIG. 7 are designated by the same references, and the description thereof is omitted and parts different from FIG. 7 are described.

Subsequently, the operation of the elevator control device according to the third embodiment will be described. In the operation of the elevator control device according to this embodiment, the description of the operation identical with or corresponding to the operation of the elevator control device shown in the second embodiment will be omitted, and the different operation will be described.

The elevator control device according to this embodiment includes the non-linear element section 90 and the clock 91 within the charging/discharging control circuit 21. Then, a given time zone is set on the clock 91. Also, a given power value indicative of the energy supplied from the commercial power supply 1 is set on the non-linear element section 90 in accordance with the time zone set on the clock 91 in advance.

For example, a time zone such as 13:00 to 16:00 where a demand for an electric power becomes peak is set on the clock 91 as a given time zone. On the other hand, 0 is set on the non-linear element section 90 as a given power value. Also, a given power value within a range of the contracted electric powers based on a contraction with an electric power company is set on time zones except for the given time zone.

As a result, in the above-described time zone, the required power value Pw corresponds to the discharging power value Pd as it is even through the non-linear element section 90, and all of the required power Pw is discharged from the power storing unit 22 and supplied.

As described above, the supply of the electric power to the elevator at the time where a demand for the electric power is peak is conducted by only the power storing unit 22, thereby being capable of suppressing the power consumption caused by the elevator at the time where the demand for the electric power is peak.

Also, in the time zones except for the above-described time zone, the given power value within the range of the contracted powers based on the contraction with the electric power company is subtracted from the required power value Pw by the non-linear element section 90, its difference value is outputted from the non-linear element section 90 as the discharging power value Pd, and the electric power is discharged from the power storing unit 22 on the basis of the discharging power value Pd.

As described above, in the time zones except for the given time zone, most of the electric power necessary for the operation of the elevator can be stably supplied by the given power value within the range of the contracted electric power based on the contraction with the electric power company, and the electric power as much as the short electric power stably supplied from the electric power company is supplied from the power storing unit 22, and the costs necessary for plant and equipment investment of the power storing unit 22 can be reduced.

(Fourth Embodiment)

An elevator control device according to yet still another embodiment of the present invention will be described. The structure of the elevator control device according to this embodiment is identical with the structure of the elevator control device according to the first embodiment shown in FIG. 1, and therefore its description will be omitted. Also, the circuit structure of the charging/discharging circuit provided in the elevator control device according to this embodiment is identical with the circuit structure of the charging/discharging circuit 23 provided in the elevator control device according to the first embodiment shown in FIG. 2, and therefore its description will be omitted. Further, the structure of the inverter control circuit and the required-power arithmetically operating circuit provided in the elevator control device according to this embodiment is identical with the structure of the inverter control circuit 14 and the required-power arithmetically operating circuit 20 provided in the elevator control device according to the first embodiment shown in FIG. 3, and therefore its description will be omitted.

Figure 9:
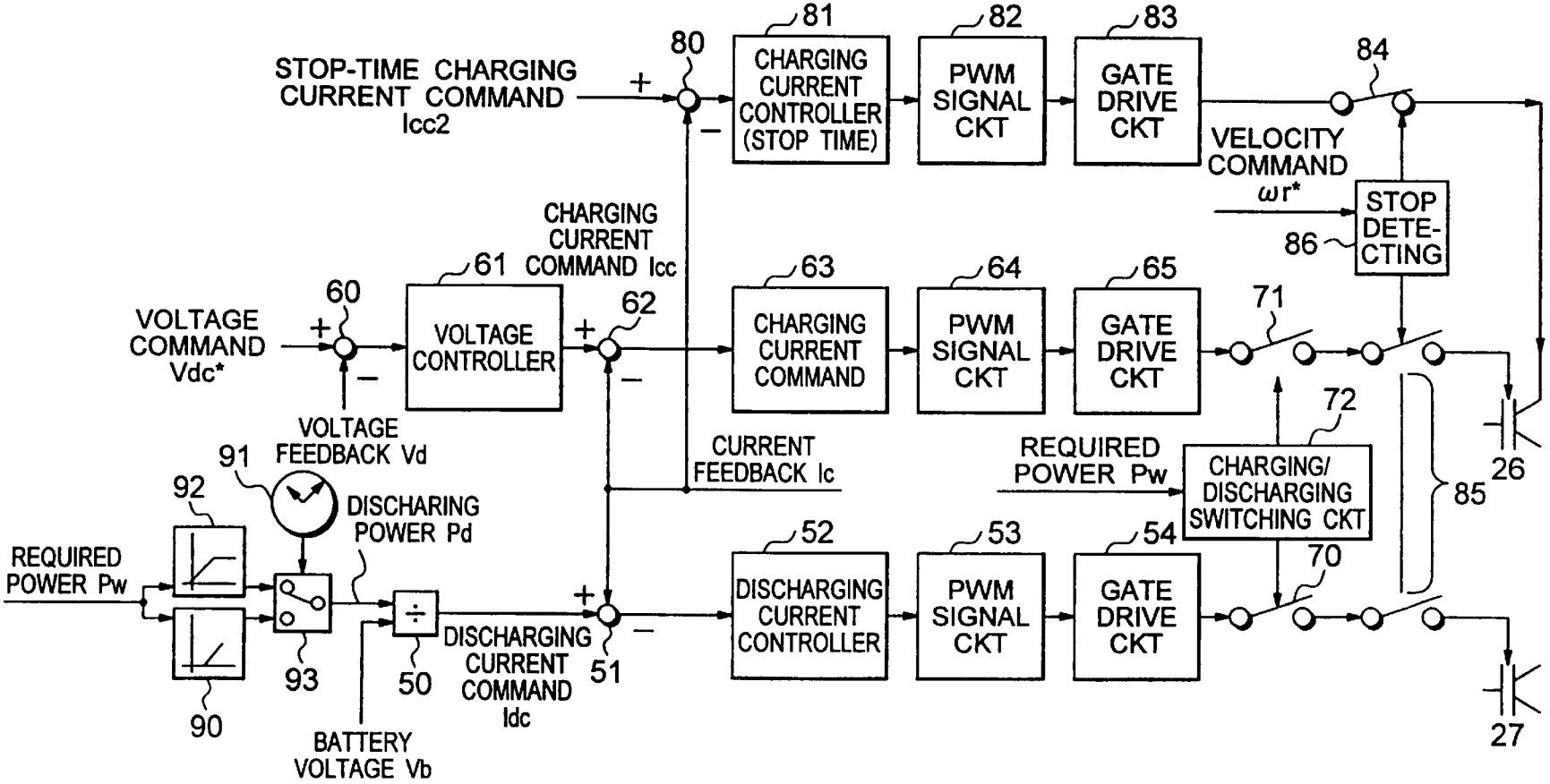
FIG. 9 is a block diagram showing the structure of a charging/discharging circuit in an elevator control circuit in accordance with a fourth embodiment of the present invention.

Then, the charging/discharging control circuit provided in the elevator control device according to this embodiment will be described with reference to FIG. 9. FIG. 9 is a block diagram showing the structure of a charging/discharging circuit in an elevator control circuit in accordance with this embodiment.

Referring to FIG. 9, reference numeral 92 denotes a non-linear element section on which a given discharging power value Pd discharged from the power storing unit 22 is set. The given discharging power value Pd set on the non-linear element section 92 is directed to an electric power value within a range which can be supplied from the power storing unit 22.

Reference numeral 93 denotes a switch which is connected with the non-linear element section 92, the non-linear element section 90, the clock 91 and divider 50. The switch 93 switches the non-linear element section 92 or the non-linear element section 90 in accordance with the time zone which is set on the clock 91 in advance, and then connected to the divider 50.

In FIG. 9, parts identical with or corresponding to those in the third embodiment shown in FIG. 8 are designated by the same references, and the description thereof is omitted and parts different from FIG. 8 are described.

Subsequently, the operation of the elevator control device according to the fourth embodiment will be described. In the operation of the elevator control device according to this embodiment, the description of the operation identical with or corresponding to the operation of the elevator control device shown in the third embodiment will be omitted, and the different operation will be described.

The elevator control device according to this embodiment includes the non-linear element section 90, the non-linear element section 92, the clock 91 and the switch 93 within the charging/discharging control circuit 21.

Then, a given time zone, for example, a time zone such as 13:00 to 16:00 where a demand for the electric power with respect to the commercial power supply 1 becomes peak is set on the clock 91 as the given time zone in advance. Also, the power supply amount supplied from the commercial power supply 1 is previously set on the non-linear element section 90 in accordance with a time zone set on the clock 91. Further, the power supply amount supplied from the power storing unit 22 is previously set on the non-linear element section 92 in accordance with the time zone set on the clock 91.

The switch 93 switches the non-linear element section 90 and the non-linear element section 92 in accordance with the time zone set on the clock 91 in advance, to thereby connect the non-linear element section 90 or the non-linear element section 92 to the divider 50.

According to this embodiment, in the above-described time zone, the given electric power is stably supplied from the power storing unit 22, and the non-linear element section 92 is connected to the divider 50 in the above-described time zone so that the electric power as much as the short electric power stably supplied from the power storing unit 22 is supplied from the commercial power supply 1. In this situation, the set given electric power value is outputted to the divider 50 from the non-linear element section 92 as the discharging power value Pd.

As described above, the supply of the electric power to the elevator at the time where a demand for the electric power is peak is basically conducted by the power storing unit 22, thereby being capable of suppressing the supply of the electric power to the elevator from the commercial power supply 1 at the time where the demand for the electric power is peak. Also, in a time zone where a demand for another equipment to which an electric power is supplied is peak, most of the electric power necessary for the elevator is supplied from the power storing unit 22, thereby being capable of suppressing a total demand for the electric power. In addition, in the non-linear element section 92, even if the required power value Pw exceeds a given value, the discharging power amount is limited to a constant amount. As a result, since the commercial power supply 1 is partially used at the time where a demand for the electric power is peak, the electric power stored in the power storing unit 22 can be prevented from rapidly being consumed.

Further, in time zones except for the above-described time zone, the given electric power is stably supplied from the commercial power supply 1, and the non-linear element section 90 and the divider 50 are connected to each other so that the electric power as much as the short amount stably supplied from the commercial power supply 1 is supplied from the power storing unit 22. In this situation, the non-linear element section 90, the given power value within the range of the contracted electric powers based on the contraction with the electric power company is subtracted from the required power value Pw inputted from the required-power arithmetically operating circuit 20, and its difference value is outputted to the divider 50 as the discharging power value Pd.

As described above, in the time zones except for the given time zone, most of the electric power necessary for the operation of the elevator can be stably supplied by the given power value within the range of the contracted electric power based on the contraction with the electric power company, and the electric power as much as the short electric power stably supplied from the electric power company is supplied from the power storing unit 22, and the costs necessary for plant and equipment investment of the power storing unit 22 can be reduced.

As was described above, according to the present invention, there is provided an elevator control device, comprising: a convertor which rectifies an a.c. power and converts the a.c. power into a d.c. power; an inverter which converts the d.c. power into an a.c. power having a variable voltage and a variable frequency; an electric motor which is driven by the a.c. power having a variable voltage and a variable frequency to drive an elevator; a power storing unit which is charged with an electric power; a required-power arithmetically operating circuit which calculates a required power of the elevator which is an electric power required for the operation of the elevator or an electric power caused by the operation of the elevator; and a charging/discharging control circuit which controls the charging operation or the discharging operation of the power storing unit based on the required power of the elev. With the above structure, the electric power which has been uselessly consumed up to now can be effectively employed.

Also, according to the present invention, there is provided the elevator control device in which the charging/discharging control circuit controls so that the electric power is charged in the power storing unit when a required power of the elevator is a negative value and an electric power occurs due to the operation of the elevator, and the electric power is discharged from the power storing unit when a required power of the elevator is a positive value and the electric power is required for the operation of the elevator. With the above structure, the electric power can be effectively employed.

Further, according to the present invention, there is provided the elevator control device in which the charging/discharging control circuit controls so that the electric power is charged in the power storing unit when the required power of the elevator is 0 and the elevator stops. With the above structure, the electric power can be effectively employed.

Still further, according to the present invention, there is provided the elevator control device in which the charging/discharging control circuit controls so that the electric power is discharged from the power storing unit by an excessive electric power amount which exceeds a given electric power amount on the basis of the required power of the elevator. With the above structure, the electric power supply amount from the commercial power supply can be suppressed.

Yet still further, according to the present invention, there is provided the elevator control device in which the charging/discharging control circuit controls the electric power amount discharged from the power storing unit on the basis of a predetermined time zone. With the above structure, the electric power supply amount from the commercial power supply can be suppressed.

Yet still further, according to the present invention, there is provided the elevator control device in which the charging/discharging control circuit switches between a case in which only an excessive electric power amount which exceeds the predetermined electric power amount with respect to the required power of the elevator is discharged from the power storing unit, and a case in which the given electric power amount is stably discharged from the power storing unit. With the above structure, the electric power supply amount from the commercial power supply can be suppressed.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An elevator control device comprising:

a converter which rectifies a.c. power and converts the a.c. power into d.c. power;

an inverter which converts the d.c. power into a.c. power having a variable voltage and a variable frequency;

an electric motor which is driven by the a.c. power having variable voltage and variable frequency to operate an elevator;

a power storing unit for storing electric power and providing electric power to the inverter;

a required-power arithmetically operating circuit which calculates power required by the elevator for operation in a powered operation and electric power generated by the operation of the elevator in a regenerative operation; and a charging/discharging control circuit which controls charging- and discharging of said power storing unit based on the power required by the elevator.

2. The elevator control device as claimed in claim 1 including communication means, wherein said required-power arithmetically operating circuit calculates the power required by the elevator in a powered operation and outputs an obtained required-power to said charging/discharging control circuit through said communication means.

3. The elevator control device as claimed in claim 1, wherein said charging/discharging control circuit charges said power storing unit in a regenerative operation when the power required by the elevator is a negative value and electric power is generated due to the operation of the elevator, and discharges said power storing unit in a powered operation when the power required by the elevator is a positive value and electric power is required for the operation of the elevator.

4. The elevator control devices as claimed in claim 1, wherein said charging/discharging control circuit charges said power storing unit from a commercial power supply when the power required by the elevator is zero and the elevator is stopped.

5. The elevator control device as claimed in claim 1, further comprising a charging/discharging circuit charging and discharging said power storing unit under control of said charging/discharging control circuit, wherein said charging/discharging control circuit discharges said power storing unit based on the power required by the elevator in a powered operation when electric power is required for the operation of the elevator, and controls an output voltage from said charging/discharging circuit at a fixed voltage in a regenerative operation when electric power is generated due to the operation of the elevator.

6. The elevator control device as claimed in claim 5, wherein the fixed voltage is higher than a voltage obtained by rectifying the a.c. power voltage.

7. The elevator control device as claimed in claim 1, wherein said charging/discharging control circuit discharges the power storing unit in an amount which exceeds a fixed electric power amount based on the power required by the elevator.

8. The elevator control device as claimed in claim 1, wherein said charging/discharging control circuit discharges said power storing unit based on a time period.

9. The elevator control device as claimed in claim 1, wherein said charging/discharging control circuit switches between discharging only an electric power amount which exceeds a threshold electric power amount with respect to the power required by the elevator, and stably discharging said power storing unit.

10. The elevator control device as claimed in claim 1, wherein said required-power arithmetically operating circuit calculates the power required by the elevator based on one of (i) a voltage command value for applying a voltage to the electric motor and an electric motor current and (ii) a current command value for supplying a current to the electric motor.

* * * * *